United States Patent [19]

Rehm et al.

[11] Patent Number: 4,789,032

[45] Date of Patent: Dec. 6, 1988

[54] ORIENTING AND CIRCULATING SUB

[76] Inventors: William A. Rehm, 12558 Westerly Ln., Houston, Tex. 77077; William J. McDonald, 11727 Woodsage, Houston, Tex. 77024; William C. Maurer, 4902 Caris, Houston, Tex. 77091; Curtis E. Leitko, Jr., 7038 Woodbluff, Houston, Tex. 77040

[21] Appl. No.: 101,249

[22] Filed: Sep. 25, 1987

[51] Int. Cl.[4] ..... E21B 7/08

[52] U.S. Cl. ..... 175/45; 175/73; 175/256

[58] Field of Search ..... 175/45, 61, 73, 74, 175/101, 107, 256

[56] References Cited

U.S. PATENT DOCUMENTS

| | | | |
|---|---|---|---|
| 3,713,500 | 1/1973 | Russell | 175/73 |
| 3,765,494 | 10/1973 | Kielman, Jr. | 175/45 |
| 4,077,657 | 3/1978 | Trzeciak | 175/61 |
| 4,298,077 | 11/1981 | Emery | 175/107 |
| 4,379,493 | 4/1983 | Thibodeaux | 175/61 |

OTHER PUBLICATIONS

G. W. Pickett, "Techniques and Deflection Tools in High-Angle Drilling: Past, Present and Future", Journal of Petroleum Technology, Apr. 1967, pp. 469–475.

*Primary Examiner*—George A. Suchfield
*Assistant Examiner*—Terry L. Melius
*Attorney, Agent, or Firm*—Neal J. Mosely

[57] ABSTRACT

An orienting and circulating sub is disclosed for connection in an apparatus for angular drilling in the earth. The drilling apparatus comprises a drill string extending into a substantially vertical well bore in the earth supporting a fluid operated motor and drill bit at its lower end. The drill bit is supported for angular drilling by either using a bent sub for supporting the drilling motor or be using a drilling motor with a bent housing. A surveying tool is connected above the motor for determining and controlling the direction of drilling. A mule shoe keying sub is connected to the surveying tool for orienting the position of the motor in relation to said surveying tool. The orienting sub comprises a tubular housing formed in two sections threaded together with one end connected to the surveying tool by the mule shoe keying sub and the other end connected to the bent sub or to the bent motor housing. The orienting sub has a sleeve mounted in the end of the lower housing section with a key for receiving the mule shoe for locating the sub in relation to the surveying tool. The sleeve is oriented in the housing by a system of fine grooves and splines on the sub section and on the sleeve which permit fine angular adjustment. A modified Baker float valve is positioned in the lower end of the tool with a flapper check valve. A piston valve with shear pin is provided to open a bypass valve for draining the drill string during lifting.

24 Claims, 3 Drawing Sheets

ORIENTING AND CIRCULATING SUB

BACKGROUND OF THE INVENTION

Field of the Invention

This invention relates to new and useful improvements in orienting and circulating tools or subs for earth drilling equipment and more particularly to a tool or sub for orienting a bent sub or bent motor housing used in angular drilling in relation to the surveying tool in the drill string used to control the direction of the hole being drilled.

Brief Description of the Prior Art

Drilling apparatus wherein a drill bit is operated by a down hole motor such as positive displacement fluid motors or a turbine driven motors, are well known in the prior art. In such motors, the drill bit is rotated by a rotor being turned by flow of fluid, such as drilling fluid through the motor assembly. These down hole motors and drills are used in many cases for angular drilling of wells by supporting the motor on a bent sub or by using a motor having a bent housing. In such apparatus, a surveying tool is connected in the drill string above the motor to sense the direction of drilling and control the direction. In such apparatus, it is necessary to locate the bend in the bent sub or the bend in a bent motor housing accurately in relation to the surveying tool to permit accurate control. An accurate orientation of the bent sub or bent motor housing in relation to the surveying tool has been difficult with prior art equipment and such difficulties have been overcome by this invention.

SUMMARY OF THE INVENTION

It is therefore one object of this invention to provide a new and improved angular earth drilling apparatus.

Another object of this invention is to provide a new and improved angular earth drilling apparatus comprising a drill string having a surveying tool and a drilling motor supported thereon by a bent sub, or in lieu thereof a drilling motor having a bent housing, with means for orienting the bend in the bent sub or bent motor housing accurately in relation to the surveying tool.

Another object of this invention is to provide a new and improved angular earth drilling apparatus comprising a drill string having a surveying tool and a drilling motor supported thereon by a bent sub, or in lieu thereof a drilling motor having a bent housing, with an orienting tool or sub for orienting the bend in the bent sub or bent motor housing accurately in relation to the surveying tool.

Another object of this invention is to provide a new and improved angular earth drilling apparatus comprising a drill string having a surveying tool and a drilling motor supported thereon by a bent sub, or in lieu thereof a drilling motor having a bent housing, the surveying tool being connected positively to the bent sub or housing by a mule shoe keying apparatus connected to an orienting tool or sub for orienting the bend in the bent sub or bent motor housing accurately in relation to the surveying tool.

Still another object of this invention is to provide an improved orienting sub for connecting a bent sub or bent motor housing to a surveying tool in angular earth drilling apparatus and to orient the bend in the sub or motor housing accurately in relation to the surveying tool.

Still another object of this invention is to provide an improved orienting sub for connecting a bent sub or bent motor housing to a surveying tool in angular earth drilling apparatus and to orient the bend in the sub or motor housing accurately in relation to the surveying tool and having a modified float valve with a flapper check valve therein.

Still another object of this invention is to provide an improved orienting sub for connecting a bent sub or bent motor housing to a surveying tool in angular earth drilling apparatus and to orient the bend in the sub or motor housing accurately in relation to the surveying tool and having a piston valve controled by a shear pin for opening a bypass valve to empty the drill string during lifting.

Still another object of this invention is to provide an improved orienting sub for connecting a bent sub or bent motor housing to a surveying tool in angular earth drilling apparatus and to orient the bend in the sub or motor housing accurately in relation to the surveying tool and having a modified float valve with a flapper check valve therein and a piston valve controled by a shear pin for opening a bypass valve to empty the drill string during lifting.

Still another object of this invention is to provide an improved orienting sub for connecting a bent sub or bent motor housing to a surveying tool in angular earth drilling apparatus and to orient the bend in the sub or motor housing accurately in relation to the surveying tool utilizing a spline and groove connecting for a sleeve supporting a key which receives a mule shoe connection from the surveying tool and which is capable of fine angular adjustment.

Other objects of this invention will come apparent from time to time throughout the specification and claims as hereinafter related.

The foregoing objects and other objects of the invention are accomplished by an orienting and circulating sub disclosed for connection in an apparatus for angular drilling in the earth. The drilling apparatus comprises a drill string extending into a substantially vertical well bore in the earth supporting a fluid operated motor and drill bit at its lower end. The drill bit is supported for angular drilling by either using a bent sub for supporting the drilling motor or be using a drilling motor with a bent housing. A surveying tool is connected above the motor for determining and controlling the direction of drilling. A mule shoe keying sub is connected to the surveying tool for orienting the position of the motor in relation to said surveying tool. The orienting sub comprises a tubular housing formed in two sections threaded together with one end connected to the surveying tool by the mule shoe keying sub and the other end connected to the bent sub or to the bent motor housing. The orienting sub has a sleeve mounted in the end of the lower housing section with a key for receiving the mule shoe for locating the sub in relation to the surveying tool. The sleeve is oriented in the housing by a system of fine grooves and splines on the sub section and on the sleeve which permit fine angular adjustment. A modified Baker float valve is positioned in the lower end of the tool with a flapper check valve. A piston valve with shear pin is provided to open a bypass valve for draining the drill string during lifting.

DESCRIPTION OF THE PREFERRED EMBODIMENT

Figure 1:
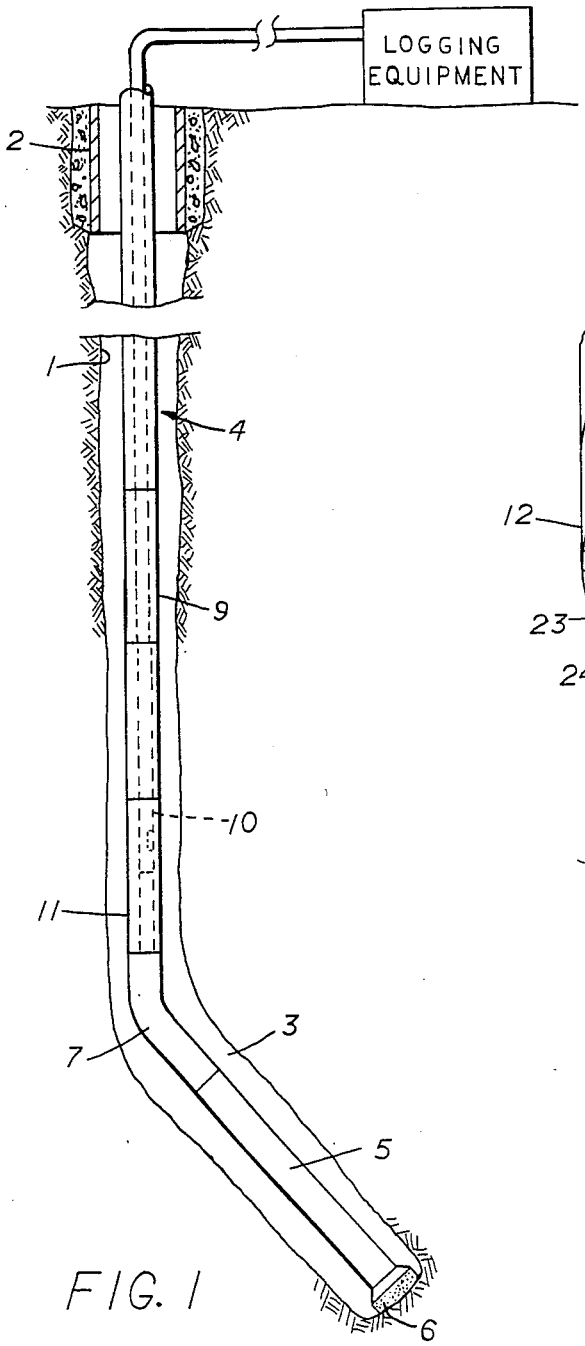
FIG. 1 is a view diagrammatically showing a down hole motor supported on a bent sub from a surveying tool by an orienting and circulating tool or sub in position for angular earth drilling with the well bore shown in section illustrating a preferred embodiment of the invention.

Referring to the drawings by numerals of reference, and more particularly to FIG. 1, there is shown a vertical section through a bore hole 1 in the earth, with a casing 2 in place, and a lower portion 3 extending at an angle, illustrating slant or angular drilling.

A drill string 4 extends into the substantially vertical portion of well bore 1 with the drilling motor 5 in the angular bore hole 3. Drilling motor 5 is a fluid operated motor with a drill bit 6 operated thereby. Motor 5 may be a positive displacement motor, e.g. a Moineau motor, or a turbodrill.

Figure 1A:
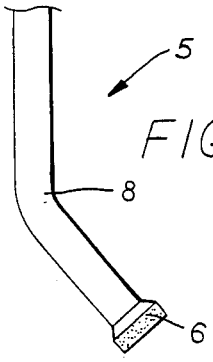
FIG. 1A is a fragmentary view of the lower end of the apparatus shown in FIG. 1 where a motor with bent housing is used in place of the bent sub supporting the drilling motor.
Figure 2A:
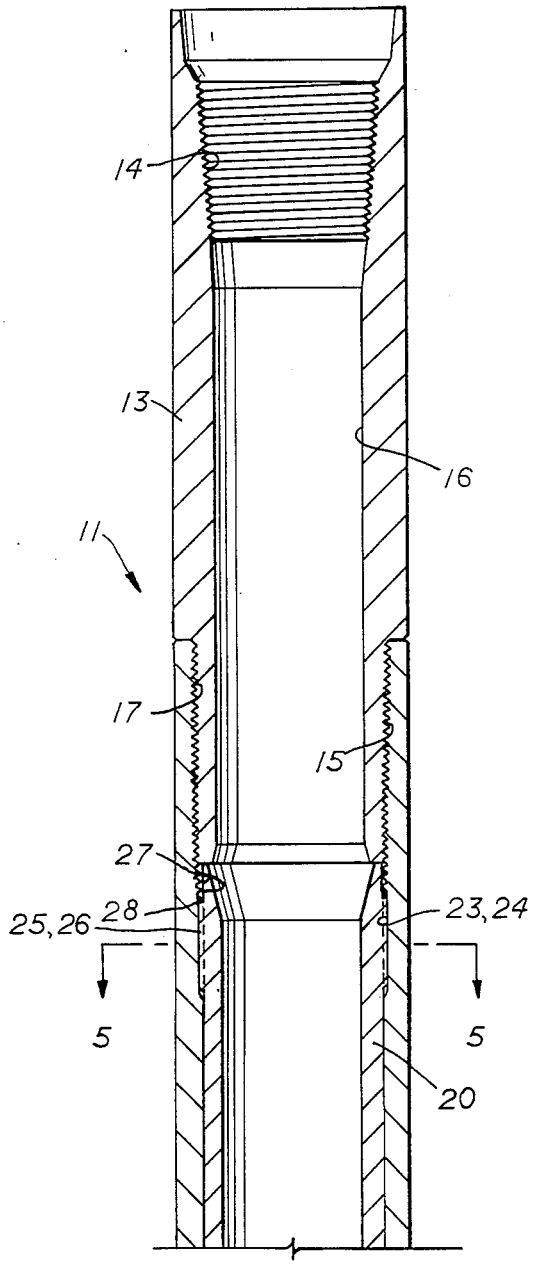
FIGS. 2 and 2*a* taken together constitutes a longitudinal sectional view showing details of the orienting and circulating tool or sub.
Figure 2B:
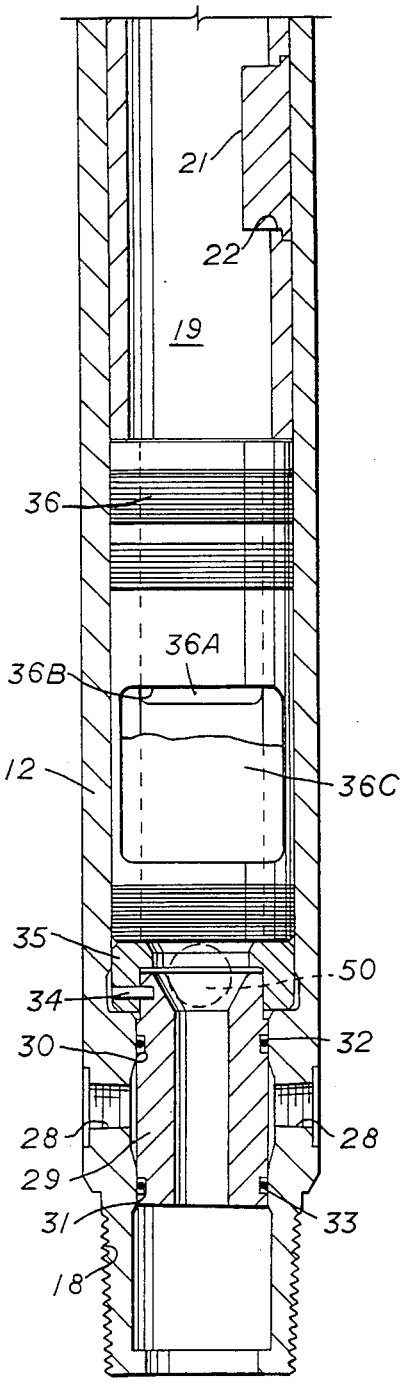

Motor 5 is supported by a bent sub 7 at a substantial angle to the vertical portion of well bore 1 for continuing the drilling of the well bore portion 3 at an angle to the vertical portion thereof. In FIG. 1A, an alternate embodiment is shown where the motor 5 has a bent housing 8 which is used in lieu of bent sub 7.

A surveying tool 9 is connected in the drill string 4 above the motor for determining and controlling the direction of drilling. A mule shoe keying sub 10 is connected to the surveying tool 9 for connecting and orienting the position of the motor 5 in relation to the surveying tool.

A circulating and orienting sub 11 is connected to the surveying tool 9 by the mule shoe keying sub 10 at one end and is connected at the other end to bent sub 7 or to bent motor housing 8 in the embodiment of FIG. 1A. The circulating and orienting sub 11 includes means to adjust the angular orientation of the point of connection to mule shoe keying sub 10 in relation to the connection to bent sub 7 or bent motor housing 8. Details of construction of mule shoe keying sub 10 and circulating and orienting sub or tool 11 are shown in FIGS. 2A, 2A, and 3–5 of the drawings.

Circulating and orienting sub or tool 11 comprises a lower tubular housing portion 12 and an upper housing or connecting sub 13. Connecting sub 13 has female threads 14 at its upper end and male threads 15 and an open bore 16 extending longitudinally thereof.

Lower housing portion 12 has female threads 17 at its upper end and male threads 18 at its lower end. A longitudinal passageway 19 extends the entire length of lower housing portion 12. An orienting, receiving sleeve 20 is fitted in the upper end of lower housing portion 12 and has an orienting key 21 supported in an opening 22 in the side wall thereof. Key 21 extends radially inward of passageway 19 and cooperates with the mule shoe as described below.

The upper end of lower housing portion 12 has a plurality of longitudinally splines 23 and grooves 24 which are equal in size and equally spaced around the wall of the housing. Sleeve 20 has a plurality of longitudinal splines 25 and grooves 26 which are equal in size and equally spaced therearound and fit the grooves 24 and splines 23 of housing portion 12. This system of grooves and splines permits installation of sleeve 20 in housing portion 12 with incremental adjustment of the angular orientation by amounts corresponding to the spacing of the grooves and splines in the connection. The upper end of sleeve 20 has a peripheral groove 27 sealed by O-ring 28.

The lower end of lower housing portion 12 has a plurality of side openings 28. A seal sleeve 29 is positioned in closing relation to openings and has upper and lower grooves 30 and 31 sealed by O-rings 32 and 33, respectively. The upper end of seal sleeve 29 is keyed by shear pin 34 to retainer ring 35.

An annular, elongated float valve 36 (a modified Baker float valve) is positioned between the upper surface of retainer ring 35 and the bottom end of orienting sleeve 20. Baker float 36 is open longitudinally and forms part of the passageway extending the entire length of the orienting sub or tool 11. Float valve 36 has a flapper check valve 36*a*, spring loaded closed, about half way along its length. The side opening 36*b* in float valve 36 is closed by a metal cover 36*c* tack welded in place.

Figure 3:
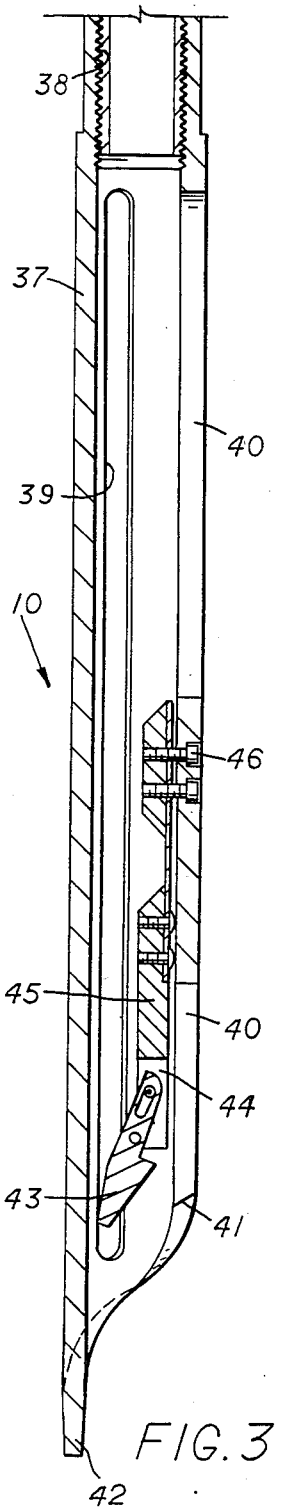
FIG. 3 is a longitudinal cross section of a mule shoe sub used to key the surveying tool to the orienting tool or sub.
Figure 4:
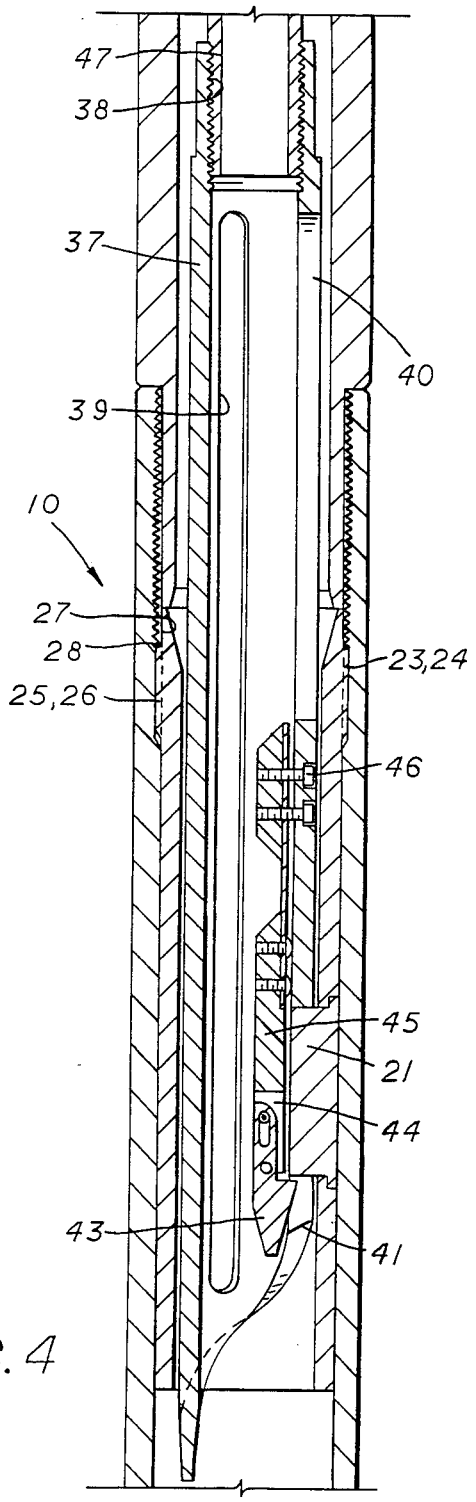
FIG. 4 is a longitudinal cross section of a mule shoe sub of FIG. 3 in place keying the surveying tool to the orienting tool or sub.

Mule shoe keying sub 10 is shown in FIG. 3 and its connection to orienting sub 11 is shown in FIG. 4 Mule shoe keying sub 10 comprises a tubular housing 37 which is internally threaded as at 38 for connection to the surveying tool 9. Tubular housing 37 has a plurality of longitudinal slots 39 and 40 and is cut away as shown at 41 to a guide tip portion 42. A spring-loaded latch member 43 is pivotally supported on the end 44 of latch support member 45 secured by machine screws 46 to the wall of tubular housing 37.

OPERATION

This apparatus is assembled and operated by assembling the orienting sub or tool 11 on bent sub 7 by threaded connection on the threaded pin 18. The drilling motor 5 is installed on bent sub 7 by threaded connection. Alternatively, orienting sub or tool 11 may be installed directly to the bent housing 8 of the alternate motor 5 shown in FIG. 1A.

Figure 5:
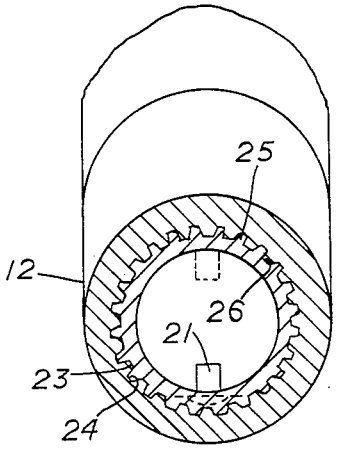
FIG. 5 is a sectional view taken on the line 5—5 of FIG. 2A showing the splined connection for orienting the key for the mule shoe sub to position it accurately in relation to the bend in the bent sub or bent motor housing used for angular drilling.

Orienting sleeve 20 is adjusted angularly, as shown in FIG. 5, to position key 21 in alignment with the bend in bent sub 7, or alternatively, the bend in bent motor housing 8 (in FIG. 1A). With the orienting sleeve 20 properly positioned, mule sleeve sub 10 is first installed on the lower end of surveying tool 9 and then slid into the upper end of the orienting sub. As mule shoe sub 10 is slid into position, the lower portion of slot 40 and the guide portion 41 and 42 engages key 21 and guides the connection until the end of slot 40 engages the upper end of key 21 and latch 43 snaps into latching position as seen in FIG. 4.

With the orienting sub connected in place as just described, the bend in bent sub 7 or in bent motor housing 8 is properly aligned with surveying tool 9 so that it can control the drilling in the direction of the bend.

The Baker float valve 36 with flapper valve 36*a* protects the equipment against backflow of drilling fluid or formation fluids. The sleeve valve 29 normally closes the bypass ports 28. When the drill string is being lifted, it is desirable to unload the drilling fluid to reduce the lifting load. To accomplish this, a ball 50 (shown in dotted line) is dropped into the drill string. Ball 50 is of a size permitting it to pass through the drill string and orienting sub 11 to close against the seat of the sleeve valve 29. The application of fluid pressure against the ball 50 will shear the pin 34 and move sleeve valve 29 downward to open valve ports 28 and allow drilling fluid to flow out from the drill string. The combining of the Baker float valve 36 and sleeve valve 29 into this apparatus produces a structure which is substantially shorter than conventional equipment where functions of this type have been provided in separate tool components. This permits the surveying tool 9 to be located close to the motor 5 and produces more accurate control of the drilling.

While this invention has been described fully and completely, with special emphasis on a single preferred embodiment, it should be understood that, within the scope of the appended claims, this invention may be practiced otherwise than as specifically described herein.

What is claimed is:

1. An apparatus for angular drilling in the earth comprising a drill string extending into a substantially vertical well bore in the earth, a fluid operated motor and drill bit operated thereby secured on the bottom end of said drill string, means supporting at least a part of said motor and drill bit at a substantial angle to said substantially vertical well bore for continuing the drilling of said well bore at an angle to the substantially vertical portion thereof, a surveying tool connected in said drill string above said motor for determining and controlling the direction of drilling, a mule shoe keying sub connected to said surveying tool for orienting the position of said motor in relation to said surveying tool, and an orienting sub connected to said mule shoe keying sub at one end and connected at the other end to said means supporting said motor at an angle, and including means to orient angularly the point of connection to said mule shoe keying sub in relation to said means supporting said motor at an angle.

2. An apparatus for angular drilling in the earth according to claim 1 in which said motor is connected to said drill string by a bent sub, and said angular adjusting means being operable to adjust the orientation of the point of connection to said mule shoe keying sub in relation to the bend in said bent sub.

3. An apparatus for angular drilling in the earth according to claim 1 in which said motor is connected to said drill string by a bent sub, and said angular adjusting means being operable to adjust the orientation of the point of connection to said mule shoe keying sub in relation to the bend in said bent sub to position said motor and drill bit in the same plane as said surveying tool.

4. An apparatus for angular drilling in the earth according to claim 1 in which said motor has a bent housing, and said angular adjusting means being operable to adjust the orientation of the point of connection to said mule shoe keying sub in relation to the bend in said motor housing.

5. An apparatus for angular drilling in the earth according to claim 1 in which said motor has a bent housing, and said angular adjusting means being operable to adjust the orientation of the point of connection to said mule shoe keying sub in relation to the bend in said motor housing to position said motor and drill bit in the same plane as said surveying tool.

6. An apparatus for angular drilling in the earth according to claim 1 in which said orienting sub includes means connecting the same, and to said mule sub said mule sub connecting means comprising a key member cooperable with said orienting sub and means to adjust the same to a predetermined position in relation to said mule sub and said surveying tool.

7. An apparatus for angular drilling in the earth according to claim 6 in which said adjusting means comprises means to adjust the orientation of said key member angularly in said orienting sub.

8. An apparatus for angular drilling in the earth according to claim 7 in which said orienting sub comprises a tubular housing, including a tubular sleeve fitted therein to support said key member, and said adjusting means comprises means to adjust the angular orientation of said sleeve in said housing.

9. An apparatus for angular drilling in the earth according to claim 8 in which said tubular housing has a plurality of internal, longitudinally extending grooves and splines at one end thereof and equally spaced circumferentially therein, said tubular sleeve has a plurality of external, longitudinally extending grooves and splines at one end thereof sized and spaced to fit said grooves and splines in said housing, and said splines and grooves in said housing and said sleeve cooperating to comprise said angular adjusting means for adjusting the angular orientation of said sleeve in said housing.

10. An apparatus for angular drilling in the earth according to claim 9 in which said housing is formed in two sections secured together by a threaded connection formed by male threads on one section threaded into female threads in the other section, said internal grooves and splines in said housing being in the end of said female threaded section, and said sleeve being abutted and secured in place by the end of said male threaded section when said sections are threaded together.

11. An orienting and circulating sub for connection in an apparatus for angular drilling in the earth comprising a drill string extending into a substantially vertical well bore in the earth, a fluid operated motor and drill bit operated thereby secured on the bottom end of said drill string, means supporting at least a part of said motor and drill bit at a substantial angle to said substantially vertical well bore for continuing the drilling of said well bore at an angle to the substantially vertical portion thereof, a surveying tool connected in said drill string above said motor for determining and controlling the direction of drilling, a mule shoe keying sub connected to said surveying tool for orienting the position of said motor in relation to said surveying tool, said orienting and circulating sub comprising a housing adapted to be connected to said mule shoe keying sub at one end and adapted to be connected at the other end to said means supporting said motor at an angle, and including means to orient angularly the point of connection to said mule shoe keying sub in relation to said means supporting said motor at an angle.

12. An orienting and circulating sub according to claim 11 in which said motor is connected to said drill string by a bent sub, and said angular adjusting means being operable to adjust to orientation of the point of connection to said mule shoe keying sub in relation to the bend in said bent sub.

13. An orienting and circulating sub according to claim 11 in which said motor is connected to said drill string by a bent sub, and said angular adjusting means being operable to adjust the orientation of the point of connection to said mule shoe keying sub in relation to the bend in said bent sub to position said motor and drill bit in the same plane as said surveying tool.

14. An orienting and circulating sub according to claim 11 in which said motor has a bent housing, and said angular adjusting means being operable to adjust the orientation of the point of connection to said mule shoe keying sub in relation to the bend in said motor housing.

15. An orienting and circulating sub according to claim 11 in which said motor has a bent housing, and said angular adjusting means being operable to adjust the orientation of the point of connection to said mule shoe keying sub in relation to the bend in said motor housing to position said motor and drill bit in the same plane as said surveying tool.

16. An orienting and circulating sub according to claim 11 in which said orienting sub includes means connecting the same, and to said mule sub said mule sub connecting means comprising a key member cooperable with said orienting sub and means to adjust the same to a predetermined position in relation to said mule sub and said surveying tool.

17. An orienting and circulating sub according to claim 16 in which said adjusting means comprises means to adjust the orientation of said key member angularly in said orienting sub.

18. An orienting and circulating sub according to claim 17 in which said orienting sub comprises a tubular housing, including a tubular sleeve fitted therein to support said key member, and said adjusting means comprises means to adjust the angular orientation of said sleeve in said housing.

19. An orienting and circulating sub according to claim 18 in which said tubular housing has a plurality of internal, longitudinally extending grooves and splines at one end thereof and equally spaced circumferentially therein, said tubular sleeve has a plurality of external, longitudinally extending grooves and splines at one end thereof sized and spaced to fit said grooves and splines in said housing, and said splines and grooves in said housing and said sleeve cooperating to comprise said means for adjusting the angular orientation of said sleeve in said housing.

20. An orienting and circulating sub according to claim 19 in which said housing is formed in two sections secured together by a threaded connection formed by male threads on one section threaded into female threads in the other section, said internal grooves and splines in said housing being in the end of said female threaded section, and said sleeve being abutted and secured in place by the end of said male threaded section when said sections are threaded together.

21. An orienting and circulating sub according to claim 11 additionally including a float valve with a flapper type check valve positioned in said housing below said angular orienting means.

22. An orienting and circulating sub according to claim 11 in which said housing has an inlet and an outlet end, the outlet end of said housing having side ports for discharge of drilling fluid, a sleeve valve normally closing said side ports and including a shear pin holding the same closed, said sleeve valve being operable to be opened by dropping a ball through the ball string to lodge therein and applying pressure to shear said pin and move said sleeve valve to an open position.

23. An orienting and circulating sub according to claim 11 additionally including a float valve with a flapper type check valve positioned in said housing below said angular orienting means, and in which the outlet end of said housing has side ports for discharge of drilling fluid, a sleeve valve normally closing said side ports and including a shear pin holding the same closed, said sleeve valve being operable to be opened by dropping a ball through the drill string to lodge therein and applying pressure to shear said pin and move said sleeve valve to an open position, said ball being of a size for passing through said flapper check valve.

24. An orienting and circulating sub comprising a housing for connection between a surveying tool and a bent sub for a down hole motor used for angular drilling, an orienting sleeve positioned in said housing having a key for receiving a mule shoe supported on the surveying tool for positioning the surveying tool accurately, means for adjusting the position of said orienting sleeve angularly, a float valve with a flapper type check valve positioned in said housing below said orienting sleeve and in which the outlet end of said housing has side ports for discharge of drilling fluid, a sleeve valve normally closing said side ports and including a shear pin holding the same closed, said sleeve valve being operable to be opened by dropping a ball through the drill string to lodge therein and applying pressure to shear said pin and move said sleeve valve to an open position, said ball being of a size for passing through said flapper check valve.

* * * * *